United States Patent [19]

Reid et al.

[11] 4,200,311

[45] Apr. 29, 1980

[54] SEAT BELT SECURING DEVICE

[75] Inventors: Kenneth H. Reid, Mt. Clemens; Walter T. Ozias, Jr., Warren, both of Mich.

[73] Assignee: General Motors Corporation, Detroit, Mich.

[21] Appl. No.: 8,542

[22] Filed: Feb. 2, 1979

[51] Int. Cl.[2] ..... B60R 21/10

[52] U.S. Cl. ..... 280/801; 24/241 SB

[58] Field of Search ..... 280/801, 802; 297/468, 297/469, 485; 24/241 R, 241 P, 241 PP, 241 PL, 241 PS, 241 SP, 241 SB

[56] References Cited

U.S. PATENT DOCUMENTS

| | | | |
|---|---|---|---|
| 3,877,116 | 4/1975 | Holmberg | 24/241 PP |
| 3,920,265 | 11/1975 | Nilsson | 280/808 |
| 4,109,935 | 8/1978 | Weman | 280/808 |
| 4,160,565 | 7/1979 | Matsumoto | 297/468 |

*Primary Examiner*—John J. Love
*Assistant Examiner*—Randall A. Schrecengost
*Attorney, Agent, or Firm*—Charles E. Leahy

[57] ABSTRACT

A seat belt securing device includes a C-shaped hook member having upper and lower legs spaced apart to define a belt receiving slot having a forwardly facing open end. The lower leg is pivotally mounted on a mounting bracket attached to the vehicle body and positioning the hook member adjacent the hip of the seated occupant. The upper leg is engaged by the belt upon entry of the belt into the slot and is arranged relative the pivot so that belt force applied against the hook member by a retractor associated with the belt and by restraint of the occupant maintain the hook member in a downwardly directed belt capturing position. A gate member is pivotally mounted on the mounting bracket and is spring biased to a normal position where its one end engages the upper leg to close the open end of the slot and a latch portion at its other end engages a notch in the lower leg to latch the hook member against rearward belt releasing motion. The spring yields to permit movement of the gate member to a slot opening position when engaged by the belt during engagement of the belt over the upper leg and insertion into the slot. A release lever has a generally planar body portion pivotally mounted on the mounting bracket and a laterally extending occupant accessible push button portion adapted to overlie the upper leg in spaced relation therefrom to permit limited pivotal movement of the release lever relative the hook member. The release lever also has a cam surface for pivoting the gate member out of engagement with the notch of the lower leg during the limited pivotal movement of the release lever. A further occupant depression of the push button portion causes engagement of the laterally extending push button portion with the upper leg to effect rearward pivoting movement of the hook member to release the belt therefrom.

3 Claims, 7 Drawing Figures

SEAT BELT SECURING DEVICE

BACKGROUND OF THE INVENTION

The invention relates generally to a seat belt system and more particularly to an improved push button releasable device for securing a belt in an occupant restraining position.

This invention provides an improvement in the seat belt securing device of U.S. Pat. No. 4,142,737, issued Mar. 6, 1979. filed September 27, 1976 by Gerald J. Marsh et al and U.S. Pat. No. 4,150,843, issued Apr. 24, 1979. by Kenneth H. Reid et al. Those inventions relate to a C-shaped hook member having upper and lower legs spaced apart to define a belt receiving slot having a forwardly facing open end. The lower leg is pivotally mounted on a mounting bracket attached to the vehicle body for positioning the hook member adjacent the hip of the seated occupant. A gate member is pivotally mounted on the mounting bracket and is spring biased to a normal position where its one end engages the upper leg to close the open end of the slot and a latch portion at its other end engages a notch in the lower leg to latch the hook member against rearward motion. The spring yields to permit movement of the gate member to a slot opening position when engaged by the belt during engagement of the belt over the upper leg and insertion into the slot. The belt is released by pivoting the gate member rearwardly to unlatch the hook member and pivoting the hook member rearwardly to an upwardly directed position to release the belt for windup by the retractor.

BRIEF SUMMARY OF THE INVENTION

The present invention provides a push button operated release lever for sequentially unlatching the hook member and effecting rearward pivoting movement of the hook member to release the belt.

According to the invention, a seat belt securing device includes a C-shaped hook member having upper and lower legs spaced apart to define a belt receiving slot having a forwardly facing open end. The lower leg is pivotally mounted on a mounting bracket attached to the vehicle body for positioning the hook member adjacent the hip of the seated occupant. The upper leg has a curved lower face engaged by the belt upon entry of the belt into the slot and is arranged relative the pivot so that belt force applied against the hook member by a retractor associated with the belt and by restraint of the occupant maintain the hook member in a downwardly directed belt capturing position. A gate member is pivotally mounted on the mounting bracket and is spring biased to a normal position where its one end engages the upper leg to close the open end of the slot and a latch portion at its other end engages a notch in the lower leg to latch the hook member against rearward motion. The spring yields to permit movement of the gate member to a slot opening position when engaged by the belt during engagement of the belt over the upper leg and insertion into the slot. A release lever has a generally planar body portion pivotally mounted on the mounting bracket and a laterally extending occupant accessible push buttom portion adapted to overlie the upper leg in spaced relation therefrom to permit limited pivotal movement of the release lever relative the hook member. The release lever also has a cam surface for pivoting the gate member out of engagement with the notch of the lower leg during the limited pivotal movement of the release lever. A further occupant depression of the push button portion causes engagement of the laterally extending push button portion with the upper leg to effect rearward pivoting movement of the hook member to release the belt therefrom.

One feature, object and advantage of the invention resides in the provision of a seat belt securing hook having a push button releasable latch which insures against inadvertent rearward pivoting movement of the hook member to the belt releasing position prior to occupant depression of the push button.

A further object, feature and advantage of the invention resides in the provision of a release lever actuatable by occupant depression of a push button to first unlatch the hook member for rearward pivoting movement and then effect rearward pivoting movement of the hook member to release the belt therefrom.

These and other features, objects and advantages of the invention will become apparent upon consideration of the specification and the appended drawings in which.

Description of the Preferred Embodiment

Figure 1:
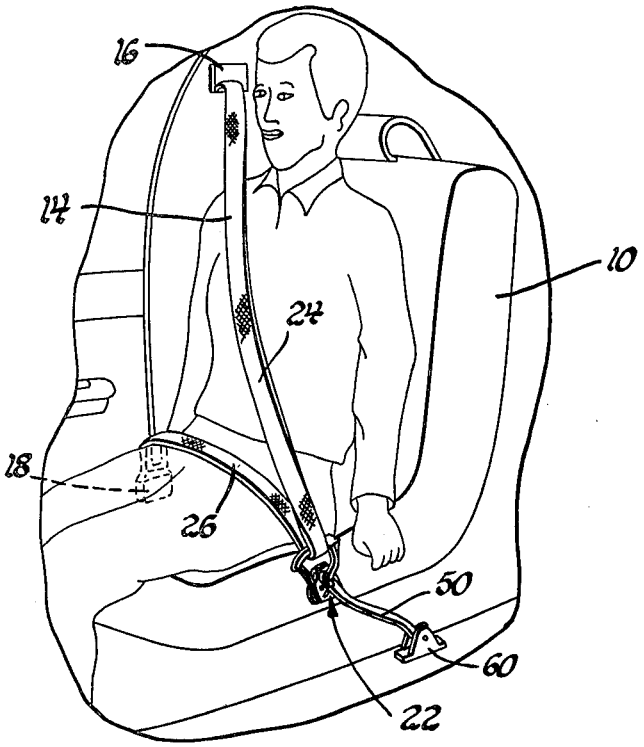
FIG. 1 shows the belt system secured in the occupant restraining position by engagement of the belt in the securing device.

Referring to FIG. 1, there is shown a motor vehicle occupant compartment wherein a vehicle seat 10 is conventionally arranged. A seat belt system for restraining the occupant in the seated position includes a single loop of seat belt 14 which has its upper end attached to the vehicle body by an inertia responsive retractor 16 and its lower end conventionally attached to the vehicle body floor pan or body sill by an anchor bracket 18. A securing device, generally indicated at 22, is attached to the vehicle body inboard the seat 10. The securing device 22 engages the belt 14 in occupant restraining position as seen in FIG. 1 wherein the belt is divided into a shoulder belt portion 24 diagonally positioned against the chest of the occupant and a lap belt portion 26 which crosses the lap of the occupant.

Figure 2:
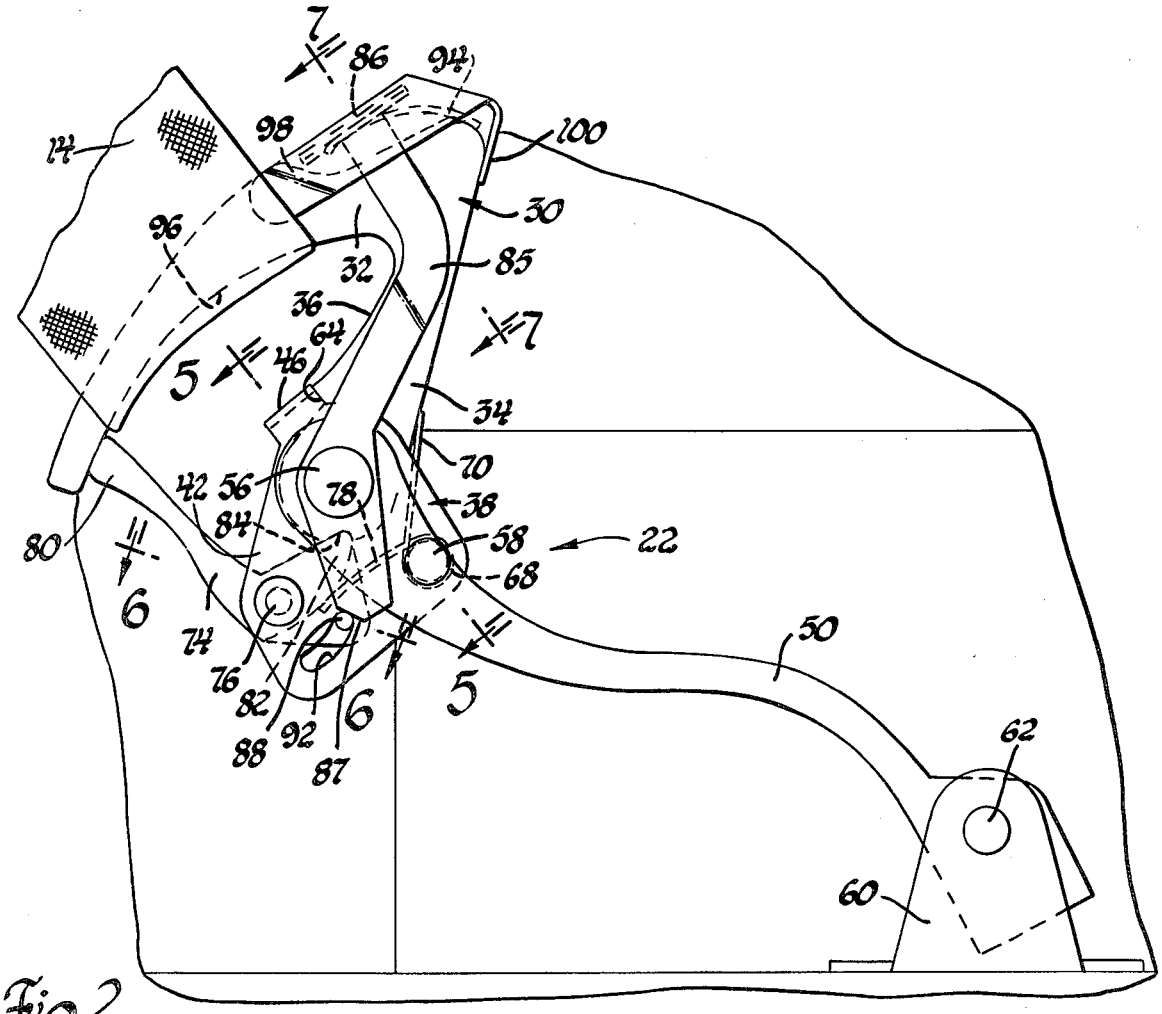
FIG. 2 is a side elevation view of the seat belt securing device showing the belt securing position thereof.

Referring to FIG. 2, the securing device 22 includes a C-shaped hook member 30 having an upper belt engaging leg 32 and a lower mounting leg 34 which are spaced apart to define a belt receiving slot 36 which opens in the forward direction.

Figure 5:
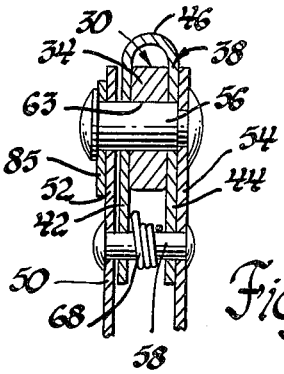
FIG. 5 is a sectional view taken in the direction of arrows 5—5 of FIG. 2.

A mounting bracket 38 is preferably a sheet metal stamping and has walls 42 and 44 which are spaced apart in parallel relation by a curved wall 46 as seen in FIG. 5 to define a space for receiving the lower leg 34 of hook member 30. The mounting bracket 38 is supported above the vehicle floor generally adjacent the hip of the seat occupant by a stamped steel strap 50 having spaced apart walls 52 and 54 at its upper end which are juxtaposed with the spaced apart walls 42 and 44 of the bracket 38. The mounting bracket 38 is nonrotatably attached to strap 50 by rivets 56 and 58. The lower end of strap 50 is pivotally attached to the vehicle body floor pan by a clevis 60 and pivot 62.

Figure 4:
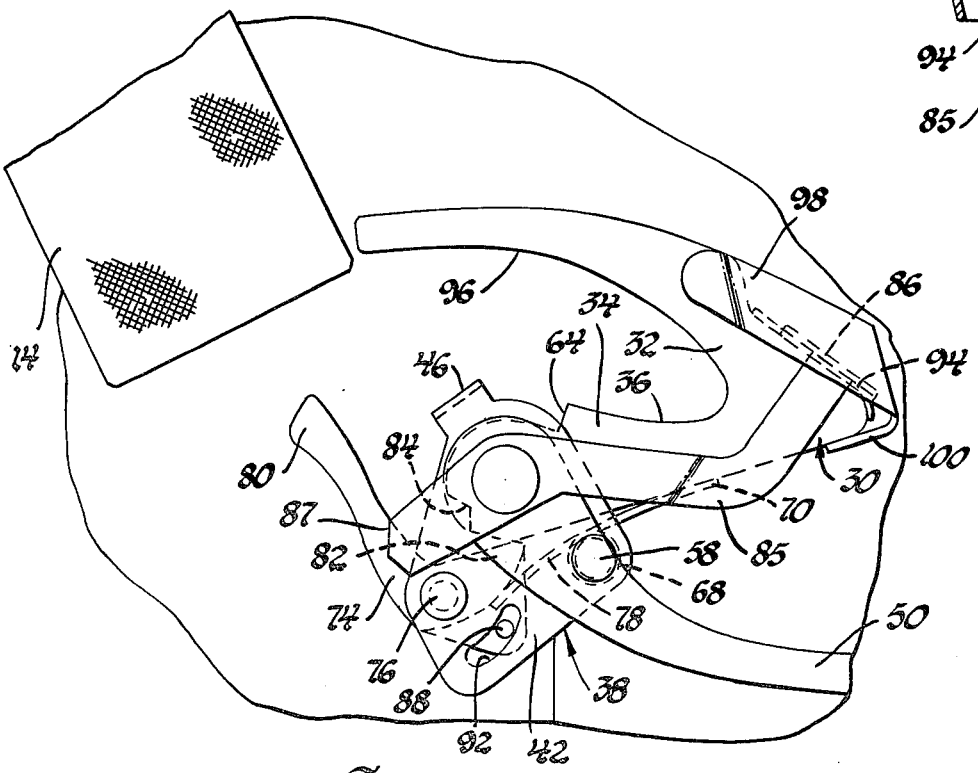
FIG. 4 is a view similar to FIGS. 2 and 3 but showing the push button depressed still further to pivot the hook member rearwardly to the belt releasing position.

As best seen in FIG. 5, the rivet 56 extends through an aperture 63 in the hook member lower leg 34 to support the hook member for pivotal movement between the positions of FIG. 2 and FIG. 4. The FIG. 2 limit of forward rotation of hook member 30 is defined by engagement of a shoulder 64 of lower leg 34 with the curved wall 46 of the mounting bracket 38. As best seen in FIGS. 2 and 5, a torsion spring 68 encircles the rivet 58 and has a leg 70 engaging the lower leg 34 to normally urge the hook member 30 to its position of FIG. 2 wherein the shoulder 64 engages curved wall 46 of mounting bracket 38. Torsion spring 68 yields to permit rearward rotation of the hook member 30 to the position of FIG. 4.

Figure 6:
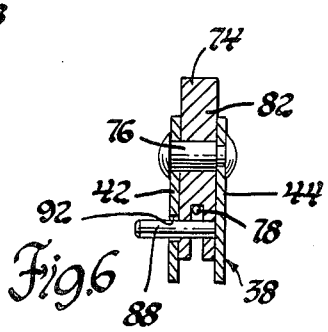
FIG. 6 is a sectional view taken in the direction of arrows 6—6 of FIG. 2.

A gate member 74 is pivotally mounted on the mounting bracket 38 adjacent the open end of the slot 36. Gate member 74 extends between the bracket walls 42 and 44 and is pivotally mounted thereon by a pivot pin 76 which extends between the bracket walls 42 and 44 as best seen in FIG. 6. The torsion spring 68 has a leg 78 which urges the gate member 74 to a normal position indicated in FIG. 2 wherein an upper end portion 80 of the gate member 74 contacts the terminal end of upper leg 32 to close the open end of the slot 36 and simultaneously position a latching portion 82 of the gate member 74 in engagement of a notch 84 of the lower leg 34 to latch the hook member 30 against rearward pivoting movement to the position of FIG. 4. The leaf spring leg 78 is yieldable to permit pivotal movement of the gate member 74 to the position of FIG. 2 so that the slot 36 is opened and the latching portion 82 is removed from the notch 84 to free the hook member 30 for rearward pivoting movement.

Figure 3:
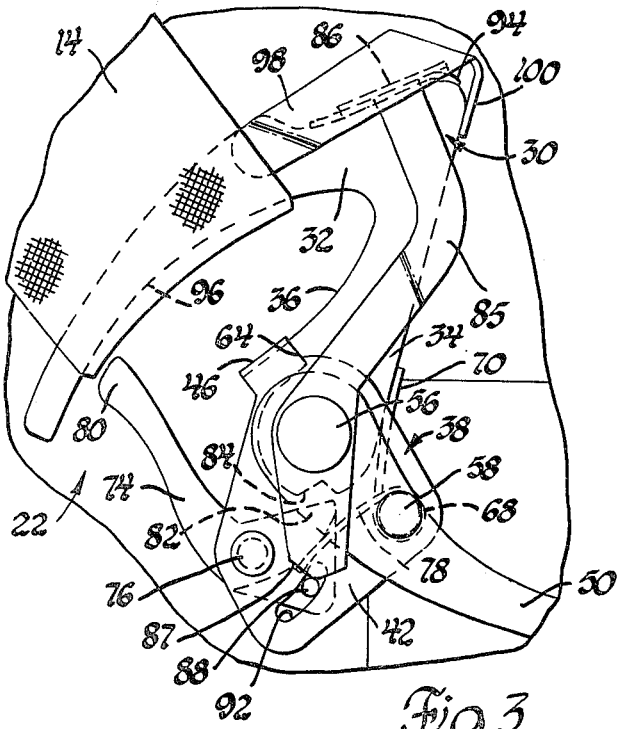
FIG. 3 is a view similar to FIG. 2 but showing the push button partially depressed to unlatch the gate member from engagement with the hook member.
Figure 7:
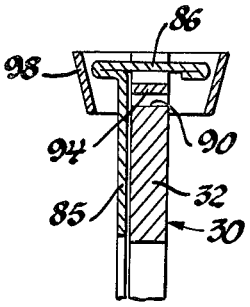
FIG. 7 is a sectional view taken in the direction of arrows 7—7 of FIG. 2.

A push button operated release mechanism is provided for sequentially pivoting the gate member to its unlatched position of FIG. 3 and then pivoting the hook member to its rearward belt releasing position of FIG. 4. As best seen in FIGS. 2 and 7, a release lever 85 is juxtaposed with the lower leg 34 of the hook member and has a laterally offset push button portion 86 which overlies the upper leg 32 in spaced relation from an abutment surface 90 thereof. The lower end of the release lever 85 has a cam surface 87 which is engageable with a pin 88 attached to the gate member 74 and projecting laterally through a curved slot 92 in the bracket wall 42 as best seen in FIG. 6. A leaf spring 94 is suitably attached to the hook member upper leg 32 and projects into engagement with the underside of the push button portion 86 to bias the release lever 85 to the normal position of FIG. 2 in which the latching portion 82 of the gate member 74 is permitted to attain its locking engagement within the notch 84 of the hook member. Spring 94 yields when the seat occupant depresses the push button portion 86 to permit pivotal movement of the release lever 85 to the position of FIG. 3 in which the cam surface 87 thereof displaces the pin 88 and gate member 74 to the position of FIG. 3 in which the latching portion 82 is withdrawn from engagement of the hook member notch 84. This limited rotary movement of the release lever 85 causes the push button portion 86 to urge leaf spring 94 into engagement with the abutment surface 90 of hook member upper leg 32 so that a further depression of the push button portion 86 rotates the hook member to the belt releasing position of FIG. 4.

The push button portion 86 is guarded against inadvertent depression by a guard member 98 best seen in FIGS. 2 and 7 which surrounds the push button portion 86 and has a leg 100 suitably attached to the hook member 30.

Operation

Referring again to FIG. 1, it will be understood that prior to entry of the occupant into the vehicle, the retractor 16 will have wound the belt to a stored position wherein the belt 14 is disposed adjacent the wall of the passenger compartment. When the occupant enters the passenger compartment and assumes the seated position, the belt system 12 may be deployed to its restraining position of FIG. 1. The occupant moves the belt system to the restraining position by hooking his thumb under the belt 14 and unwinding the belt from the retractor 16. The belt 14 is thrust against the gate member 74 causing it to pivot to its FIG. 3 position as permitted by the yielding of the leg 78 of torsion spring 68. Accordingly, the belt 14 may be inserted into the slot 36 and over the upper leg 32 of the hook member 30 as seen in FIG. 2. After the belt enters the slot 36, the torsion spring 68 returns the gate member 74 to its position of FIG. 2 wherein the slot 36 is closed and latching portion 82 engages notch 84 of hook member 30 to prevent inadvertent rearward pivoting of hook member 30 which would release the belt. When upper end portion 80 of gate member 74 engages the end of upper leg 32 and the latching portion 82 simultaneously engages notch 84, there is an audible click which assures the occupant that the belt 14 is secured. The belt 14 is held in engagement with a curved lower face 96 of upper leg 32 by the tension exerted on the belt by retractor 16 to thereby retain the belt 14 against inadvertent disengagement from the leg 32. Furthermore, the belt 14 may bear against the gate member 74 so that it will not become inadvertently disengaged, particularly in those instances where a tension reliever is associated with the retractor 16.

Referring to FIG. 1, it will be understood that the inertia responsive retractor 16 is locked against belt unwinding when the vehicle encounters a predetermined inertia stimulus such as rapid deceleration of the vehicle. Forward excursion of the occupant's lower torso is limited by engagement with the lap belt portion 26 while forward excursion of the upper torso is limited by engagement with the shoulder belt portion 24. It will be appreciated that this forward loading of the seat belt 14 tends to disengage the belt 14 from the forward facing open end of slot 36. However, the aforedescribed downward direction of the upper leg 32 and the relationship between the lower face 96 and rivet 56 cooperate to induce forward pivoting and bodily shifting movement of the hook member 30 and mounting bracket 38 as permitted by forward pivoting of the strap assembly 50. Accordingly, the hook member 30 follows the limited forward excursion of the occupant as slack is removed from belt 14 and the seat cushion is compressed, so that the belt is retained in engagement with the lower face 96 and does not become bunched up against the gate member 74 or impose any significant load thereon. Thus, it will be appreciated that the gate member 74 is desirable to insure against inadvertent disengagement of the belt from the upper leg 32 but is not mandatory for effective restraint of the occupant during an emergency situation.

When the occupant desires to alight from the vehicle, the push button portion 86 of the release lever 85 is manually depressed by the occupant. Thus, as seen by comparing FIGS. 2 and 3, the initial limited range of pivotal movement of the release lever 85 causes the cam surface 87 thereof to displace the pin 88 and gate member 74 to the position of FIG. 3 in which the latching portion 82 is withdrawn from latching engagement with the hook member notch 84. Furthermore, this limited rotary movement of the release lever 85 carries the leaf spring 94 into engagement with the abutment surface 90 of the hook upper leg member 32 so that a continued depression of the push button portion 86 rotates the hook member against the bias of the torsion spring 68 to the belt releasing position of FIG. 4.

When the seat occupant terminates depression of the push button portion 86, the torsion spring 68 urges the hook member 30 to return to its initial position of FIG. 2 while the leaf spring 94 simultaneously returns the release lever 85 to its position of FIG. 2. Accordingly, the leg 78 of torsion spring 68 is allowed to return the gate member 74 to its position of FIG. 2 wherein the latching portion 82 is re-engaged with the notch 84 of the hook member 30.

Referring again to FIG. 1, it will be understood that the securing device 22 of this invention may be used for securing a two-point lap or shoulder belt. In such an application, one end of the lap or shoulder belt would be anchored on the vehicle body by an anchor plate or a retractor. The other end of the seat belt would be reversely folded and sewn to itself to provide a loop capable of engagement over the upper leg 32 and insertion into the slot 36 of securing device 22. Furthermore, the securing device may be mounted on the occupant seat associated with the vehicle body instead of directly on the vehicle body.

Thus, the invention provides a new and improved seat belt securing device having a push button operable release lever actuatable by occupant depression of a push button to first unlatch the hook member for rearward pivoting movement and then effect rearward pivoting movement of the hook member to release the belt therefrom.

The embodiments of the invention in which an exclusive property or privilege is claimed are defined as follows:

1. In a vehicle body seat belt system having one end anchored at one side of the seated occupant and a loop of belt adapted for securement at the other side of the seated occupant, a securing device for releasably capturing the loop to position the belt in the occupant restraining position and comprising:

mounting means on the vehicle body generally adjacent the hip of the seated occupant;

a C-shaped hook member including a belt engaging leg and a mounting leg defining a belt receiving slot having a forwardly facing open end;

pivot means acting between the mounting means and the mounting leg to mount the hook member for pivotal movement between a normal position wherein the belt engaging leg and the slot extend in a downwardly belt capturing direction and a rearwardly pivoted position wherein the belt engaging leg and the slot extend in an upwardly belt releasing direction;

a locking member movably mounted on the mounting means and normally engageable with the mounting leg to block rearward pivoting movement of the hook member;

and a release lever pivotally mounted by the pivot means and having a cam surface engageable with the locking member for disengaging the locking member from the mounting leg to permit rearward pivoting movement of the hook member, said release lever having a push button mounted in an occupant accessible position adjacent the belt engaging leg of the hook member for effecting pivotal movement of the release lever relative the hook member upon occupant depression of the push button.

2. In a vehicle body seat belt system having one end anchored at one side of the seated occupant and a loop of belt adapted for securement at the other side of the seated occupant, a securing device for releasably capturing the loop to position the belt in the occupant restraining position and comprising:

mounting means on the vehicle body generally adjacent the hip of the seated occupant;

a C-shaped hook member having an upper belt engaging leg and a lower mounting leg spaced apart to define a belt receiving slot having a forwardly facing open end;

pivot means acting between the mounting means and the mounting leg to mount the hook member for pivotal movement between a normal position wherein the belt engaging leg and the slot extend in a downwardly belt capturing direction and a rearwardly pivoted position wherein the belt engaging leg and the slot extend in an upwardly belt releasing direction;

a locking member pivotally mounted on the mounting means and normally engageable with the mounting leg to block rearward pivoting movement of the hook member;

and a release lever having a generally planar body portion pivotally mounted by the pivot means and juxtaposed with the C-shaped hook member, said release lever having an occupant accessible push button extending laterally of the body portion and adapted to overlie the belt engaging leg in spaced relation therefrom to permit limited pivotal movement of the release lever relative the hook member upon depression of the push button, said release lever having a cam surface engageable with the locking member for pivoting the locking member out of engagement with the mounting leg during the limited pivotal movement of the release lever relative the mounting leg, and said push button being engageable with the belt engaging leg upon pivotal movement of the push button beyond the limited pivotal movement to pivot the hook member rearwardly to release the belt therefrom.

3. In a vehicle body seat belt system having one end anchored at one side of the seated occupant and a loop of belt adapted for securement at the other side of the seated occupant, a securing device for releasably capturing the loop to position the belt in the occupant restraining position and comprising:

mounting means on the vehicle body generally adjacent the hip of the seated occupant;

a C-shaped hook member having an upper belt engaging leg and a lower mounting leg spaced apart to define a belt receiving slot having a forwardly facing open end;

pivot means acting between the mounting means and the mounting leg to mount the hook member for pivotal movement between a normal position wherein the belt engaging leg and the slot extend in a downwardly belt capturing direction and a rearwardly pivoted position wherein the belt engaging leg and the slot extend in an upwardly belt releasing direction;

a gate member pivotally mounted on the mounting means adjacent the open end of the slot to selectively close the open end of the belt receiving slot and having a locking portion selectively engageable with the mounting leg to block rearward pivoting movement;

spring means urging the gate member to close the open end of the slot and engage the locking portion with the mounting leg to block rearward pivoting movement of the hook member;

and a release lever having a generally planar body portion pivotally mounted by the pivot means and juxtaposed with the hook member, said release lever having an occupant accessible push button extending laterally of the body portion and overlying the belt engaging leg in spaced relation therefrom to permit limited pivotal movement of the release lever relative the hook member upon depression of the push button, said release lever having a cam surface engageable with the gate member for pivoting the locking portion out of engagement with the mounting leg during the limited pivotal movement of the release lever relative the mounting leg, and said push button being engageable with the belt engaging leg upon pivotal movement of the push button beyond the limited pivotal movement to pivot the hook member rearwardly to release the belt therefrom.

* * * * *